US006429394B2

(12) United States Patent
Hunger et al.

(10) Patent No.: US 6,429,394 B2
(45) Date of Patent: Aug. 6, 2002

(54) POWER BREAKER

(75) Inventors: Olaf Hunger, Schaffhausen; Lukas Zehnder, Baden-Dättwil, both of (CH); Luc Rieffel, Muespach (FR)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 09/780,508

(22) Filed: Feb. 12, 2001

(30) Foreign Application Priority Data

Feb. 11, 2000 (DE) ..... 100 06 167

(51) Int. Cl.[7] ..... H01H 33/02
(52) U.S. Cl. ..... 218/155; 218/78; 218/84
(58) Field of Search ..... 218/43, 45, 46–48, 218/51–53, 57, 59, 60, 61, 62, 65, 69, 154, 140, 78, 84

(56) References Cited

U.S. PATENT DOCUMENTS 5,902,978 A * 5/1999 Zhender ..... 218/48
6,013,888 A * 1/2000 Thuries ..... 218/78

FOREIGN PATENT DOCUMENTS

DE 4211156 A1 10/1993
DE 19517580 C2 11/1996
DE 19613568 A1 10/1997
DE 19613569 A1 10/1997

* cited by examiner

*Primary Examiner*—Lincoln Donovan
*Assistant Examiner*—M. Fishman
(74) *Attorney, Agent, or Firm*—Burns, Doane, Swecker & Mathis, L.L.P.

(57) ABSTRACT

The power breaker is provided with at least one arcing chamber (2) which is filled with $SF_6$ gas, is rotationally symmetrical, and extends along a longitudinal axis (3). The arcing chamber (2) has a power current path with a central contact pin (14), and has a separate rated current path provided with rated current contacts (11). The arcing chamber (2) is operated by a drive linkage (4) which moves the contact pin (14) and the rated current contacts (11). The drive linkage (4) is designed such that, at the start of the disconnection process, the contact pin (14) remains in a first dead point position until the rated current path is interrupted. The contact pin (14) can then be moved in the disconnection direction at a considerably higher speed than the rated current contacts (11). Toward the end of their disconnection travel, the rated current contacts (11) run into a second dead point position. The contact pin (14) does not reach its disconnected position until after the rated current contacts (11) have ended their disconnection movement. At the start of the connection process, the rated current contacts (11) remain in this second dead point position until the pre-arcing of the switch-on arc has taken place. The rated current contacts (11) are in this way advantageously protected against damage caused by an arc.

15 Claims, 11 Drawing Sheets

Disconnected State

Disconnected State

Connected State

1st Partially Disconnected State

2nd Partially Disconnected State

3rd Partially Disconnected State

POWER BREAKER

This application claims priority under 35 U.S.C. §§119 and/or 365 to Appln. No. 100 06 167.2 filed in Germany on Feb. 11, 2000; the entire content of which is hereby incorporated by reference.

FIELD OF THE INVENTION

The invention is based on a power breaker as claimed in the precharacterizing clause of claim 1.

BACKGROUND OF THE INVENTION

The two laid-open specifications DE 196 13 568 A1 and DE 196 13 569 A1 disclose a power breaker which can be used in an electrical high-voltage network, in particular as a generator switch as well. This power breaker has a cylindrical arcing chamber which is filled with $SF_6$ gas as a quenching and insulating medium. This arcing chamber has a power current path in which the erosion-resistant consumable contacts are located, which are connected by a bridging contact in the connected state and, furthermore, it has a separate rated current path, in which the rated current contacts are fitted. The contacts in the two current paths are operated via a lever linkage from a drive, with the lever linkage being designed such that the rated current contacts always move at a slower speed than the bridging contact. During disconnection, the rated current contacts and the bridging contact move apart jointly, but the rated current path is always interrupted first, following which the current which is to be disconnected commutates onto the power current path. The power current path then continues to carry the current until it is definitively disconnected. Power breakers such as this generally require a comparatively large amount of drive energy. At the end of the disconnection travel of the contacts, the kinetic energy of the moving parts, in particular that of the rated current contacts which have a comparatively high mass, must be damped out in a complex manner.

SUMMARY OF THE INVENTION

The invention achieves the object of providing a power breaker which can be produced cost-effectively.

The advantages achieved by the invention are that the power breaker requires less drive energy, and can thus be equipped with a weaker, and thus more cost-effective, drive.

The power breaker is provided with at least one arcing chamber which is filled with an insulating medium, in particular $SF_6$ gas, is rotationally symmetrical, and extends along a longitudinal axis. The arcing chamber has a power current path with a central contact pin and a separate rated current path, which is provided with rated current contacts. The arcing chamber is operated by a drive linkage which moves the contact pin and the rated current contacts. The drive linkage is designed such that, at the start of the disconnection process, the contact pin remains in a first dead point position until the rated current path is interrupted. The contact pin can then be moved in the disconnection direction at a considerably higher speed than the rated current contacts. The rated current contacts run into a second dead point position toward the end of their disconnection travel. The contact pin does not reach its disconnected position until after the rated current contacts have ended their disconnection movement. At the start of the connection process, the rated current contacts remain in this second dead point position until the pre-arcing of the switch-on arc takes place. The rated current contacts are in this way advantageously protected against damage caused by an arc.

The power breaker has at least one piston-cylinder arrangement which moves such that it is coupled to the rated current contacts and in which a portion of the insulating medium which fills the arcing chamber is pressurized in a compression volume by a piston during disconnection. The pressurized insulating medium produced in this way, which is frequently $SF_6$ gas, is used to assist the process of blowing out the arc, as a result of which the disconnection capacity of the power breaker is advantageously improved, in particular for small disconnection currents as well.

It has been found to be particularly advantageous that, in this power breaker, at least a portion of the kinetic energy which the rated current contacts have toward the end of their disconnection travel can be used with the aid of the drive linkage for acceleration of the contact pin and for the movement of a pressure piston connected to the contact pin. If this advantage is made use of, the drive can be designed to be considerably weaker, which also has an advantageous effect on the price.

BRIEF DESCRIPTION OF THE DRAWINGS

The invention, its development and the advantages which can be achieved with it are explained in more detail in the following text with reference to the drawing, which illustrates only one possible embodiment approach and in which.

In all the figures, elements which have the same effects are provided with the same reference symbols. Only those elements which are required for direct understanding of the invention are illustrated and described.

DETAILED DESCRIPTION OF THE PREFERRED EMBODIMENTS

Figure 1:
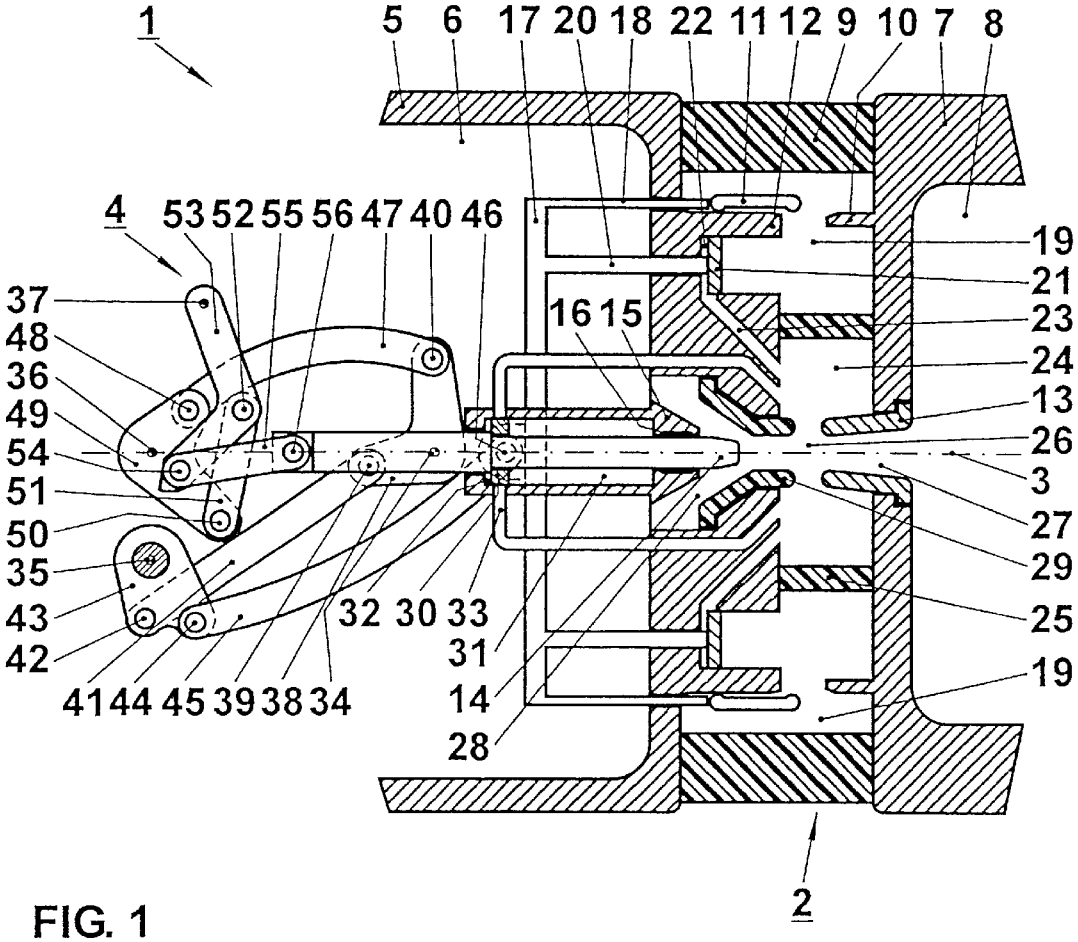
FIG. 1 shows a partial section through a first embodiment of a power breaker, illustrated in a highly simplified form, in the disconnected state.

FIG. 1 shows a partial section through a first embodiment of a power breaker 1, illustrated in a highly simplified form, in the disconnected state. The power breaker 1 has an arcing chamber 2 which in this case extends and is mounted along a common longitudinal axis 3, and is arranged concentrically with respect to said axis. The arcing chamber 2 is driven by a drive (not illustrated) via a drive linkage 4. A conventional energy storage drive can be provided, for example, as the drive. On the drive side, the arcing chamber 2 is connected to a pressure tight metallic housing 5 which is arranged concentrically with respect to the longitudinal axis 3, surrounds the drive linkage 4, and is provided on the side facing away from the arcing chamber 2 with connections (not illustrated) for supplying electrical power. The housing 5 surrounds a first blow-out volume 6.

On the side facing away from the drive, the arcing chamber 2 is connected to a pressure tight metallic blow-out housing 7, which is arranged concentrically with respect to the longitudinal axis 3 and is provided, on the side facing away from the arcing chamber 2, with connections (not illustrated) for supplying electrical power. The blow-out housing 7 surrounds a second blow-out volume 8. The housing 5 and the blow-out housing 7 are connected to one another rigidly and in a pressure tight manner by means of a pressure tight insulating tube 9 which is arranged concentrically with respect to the longitudinal axis 3, with the volume surrounded by these components being filled with pressurized $SF_6$ gas. Depending on the outside temperature to be expected, a filling pressure in the range from about 5 bar to 8 bar is provided for this power breaker 1. The housing 5 and the blow-out housing 7 are borne by an insulating support (not illustrated) and are insulated from ground. The power is transmitted from the drive to the drive linkage 4 by means of an electrically insulating component.

The arcing chamber 2 has a rated current path and, in parallel with it, a power current path which is located in the center and extends axially. When the power breaker 1 is connected, the rated current path passes from the blow-out housing 7 via an integrally formed annular contact facing 10, via axially moving rated current contacts 11 to a contact facing 12, which is integrally formed on the housing 5, and through the housing 5. When the power breaker 1 is connected, the power current path passes from the blow-out housing 7 via a contact finger arrangement 13, a contact pin 14 which is arranged centrally and is used as a bridging contact, into a contact holder 15 which is electrically conductively connected to the housing 5 and in which spiral contacts 16 are inserted, to the housing 5 and through this housing 5. However, no significant current flows through this power current path until the rated current path has been interrupted.

The rated current contacts 11 are operated via a ring 17, which is connected to the drive linkage 4 but is indicated only schematically here. The ring 17 is mechanically connected via a number of plungers 18, distributed around the circumference, to the rated current contacts 11, which are arranged such that they move in an outer arcing chamber volume 19. The plungers 18 are guided in corresponding apertures in that end wall of the housing 5 which faces the arcing chamber 2. The ring 17 is also connected to piston rods 20, which are likewise guided in corresponding apertures in that end wall of the housing 5 which faces the arcing chamber 2. The piston rods 20 are each connected to a respective piston 21, each of which separates a cylindrical compression volume 22 from the outer arcing chamber volume 19. A large number of individual pistons 21 together with the respectively associated compression volumes 22 are arranged concentrically around the longitudinal axis 3, but it is also feasible for an individual annular piston to cut off an individual annular compression volume, in which case this one piston is then operated by a number of piston rods, in order to prevent it from tilting.

Each compression volume 22 is connected to a common storage volume 24 by means of a flow channel 23. The storage volume 24 can be regarded as an inner arcing chamber volume which is separated in a pressure tight manner by means of a cylindrical, electrically insulating separating wall 25 from the outer arcing chamber volume 19. An arcing zone 26 is provided in the center of the storage volume 24, in the region between the erosion-resistant contact finger arrangement 13 and the tip of the contact pin 14. An opening 27 is provided in the center of the contact finger arrangement 13 and connects the arcing zone 26 to the blow-out volume 8. A further opening 28, which passes through that end wall of the housing 5 which faces away from the drive, connects the arcing zone 26 to the blow-out volume 6. In the region immediately adjacent to the arcing zone 26, this opening 28 is provided with a lining 29 which is designed in the form of a nozzle and is composed of an insulating material, for example, PTFE, and which comparatively closely surrounds the contact pin 14 in the connected position.

The contact pin 14 is connected on the drive side to a piston 30 which slides in a cylinder 31. The cylinder 31 is integrally formed on that end wall of the housing 5 which faces away from the drive. A compression volume 32 is provided on the drive side of the piston 30 and is used to damp out the movement of the contact pin 14 immediately before it reaches the disconnected position. During the remaining period of the disconnection movement of the contact pin 14, the compression volume 32 is connected to the storage volume 24 by means of flow channels 33.

The drive linkage 4 has four fixed-position rotation axes 34, 35, 36 and 37, which run parallel to one another. The drive axes 34, 35, 36 and 37 run at right angles to the plane of the section in FIG. 1, and thus at right angles to the longitudinal axis 3. The rotation axis 34 is the axis of a rotation shaft (not illustrated) composed of electrically insulating material, which rigidly connects a tip of an angled lever 38 to the drive (not illustrated), which is at ground potential. This electrically insulating rotation shaft is guided through the wall of the housing 5 by means of a pressure tight rotating bushing.

The metallic angled lever 38 has two rotation points 39 and 40 at the ends of its two limbs. A lever 41 of a first linkage element is articulated at the rotation point 39 and connects the angled lever 38 to a rotation point 42 of a tip of an angled lever 43, which rotates about the fixed-position rotation axis 35. The rotation point 42 is located at the end of one of the limbs of the angled lever 43, whose other limb has at its end a second rotation point 44 on which a lever 45 is articulated. The other end of the lever 45 is articulated on the ring 17 by means of a rotation point 46. In order to ensure that the ring 17 is operated without being tilted, this described lever connection is provided with the ring 17 at two mutually opposite points. This described lever connection to the ring 17 can be seen better in FIG. 3.

A lever 47 of a second linkage element is articulated at the rotation point 40 of the angled lever 38 and connects the angled lever 38 to a rotation point 48 of a tip of an angled lever 49 which rotates about the fixed-position rotation axis 36. The rotation point 48 is located at the end of one of the limbs of the angled lever 49, whose other limb has at its end a second rotation point 50 on which a lever 51 is articulated which connects the angled lever 49 to a moving rotation point 52 of an angled lever 53 which rotates about the fixed-position rotation axis 37. The rotation axis 37 is linked to the end of one limb of the angled lever 53. The rotation point 52 is located at the tip of the angled lever 53, while a further rotation point 54 is provided at the end of the other limb of the angled lever 53. A lever 55 is articulated at this further rotation point 54, and connects the angled lever 53 to a rotation point 56. The rotation point 56 is fitted on the drive end of the contact pin 14, which moves in the axial direction.

The drive linkage 4 is designed such that, during disconnection, the rated current contacts 11 which are operated by the first linkage element always open first and interrupt the rated current path, and the contact pin 14, which is initially locked in a dead point position, is not operated by the second linkage element until after this. The overall travel and the average speed of the contact pin 14 are always greater than the overall travel and the average speed of the rated current contacts 11. After an acceleration phase, the contact pin 14 moves at a substantially greater maximum speed, which is in the range from about 10 m/s to 20 m/s, than the rated current contacts 11, which move at maximum speeds in the range from about 2 m/s to 6 m/s.

Figure 6:
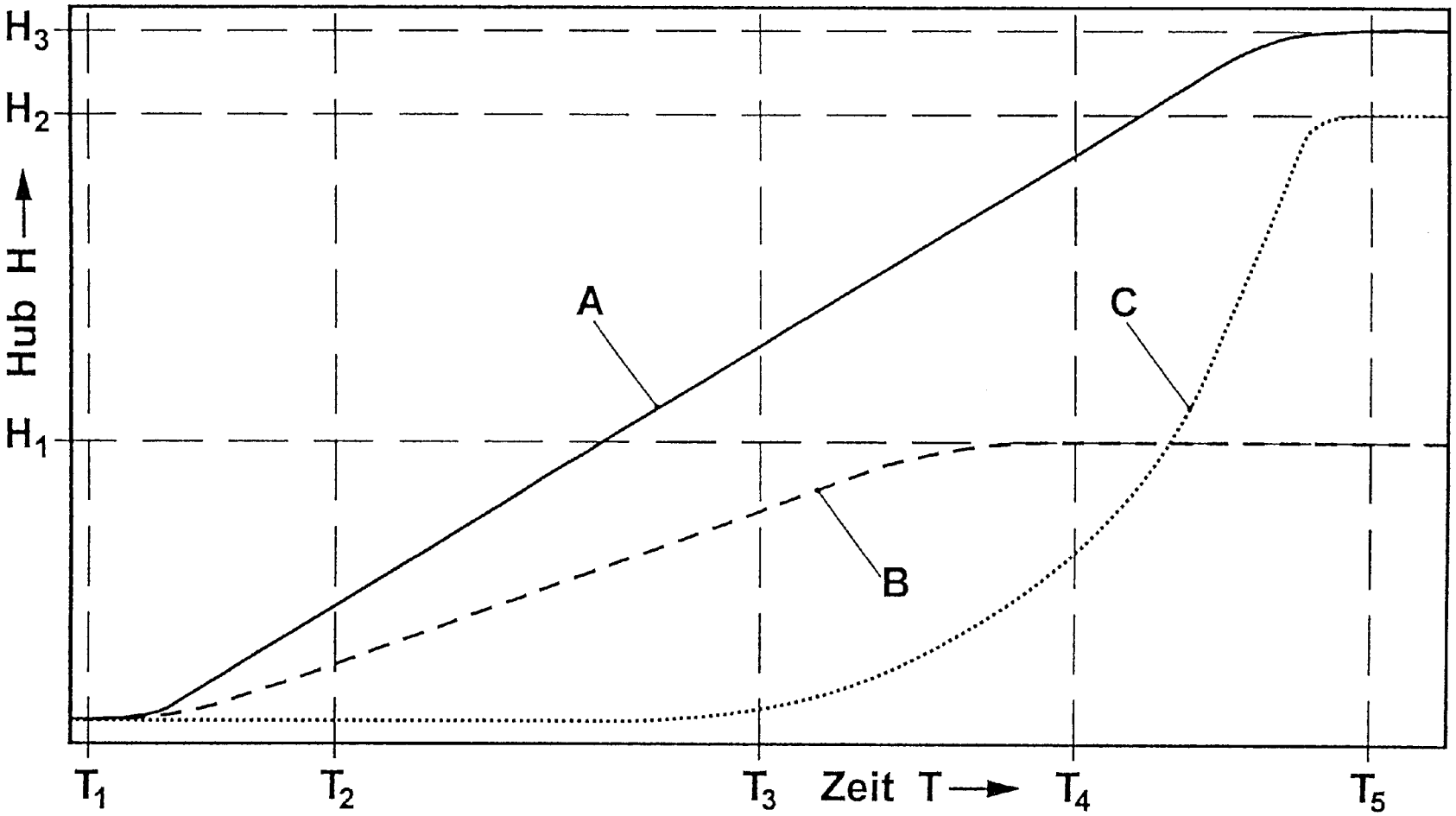
FIG. 6 shows the movement sequence for disconnection in the first embodiment of the power breaker, FIG. 7*a*, 7*b* and 7*c* each show a partial section through a second embodiment of a power breaker, illustrated in a highly simplified form, in the connected state.

During connection, the contact pin 14 always moves first and closes the circuit, and the rated current contacts 11, which are initially locked in a dead point position, are not connected until this has taken place. The movement profiles during disconnection are illustrated as a function of time in FIG. 6. Curve A in FIG. 6 shows the movement of the drive, which moves through the travel $H_3$, and the curve B illustrates the movement of the rated current contacts 11 and of the pistons 21, which move through the travel $H_1$, while the curve C illustrates the movement of the contact pin 14, which moves through the travel $H_2$. It can clearly be seen that the contact pin 14 moves through a considerably greater travel than the rated current contacts 11, and that it moves at a substantially greater maximum speed than the rated current contacts 11.

Figure 2:
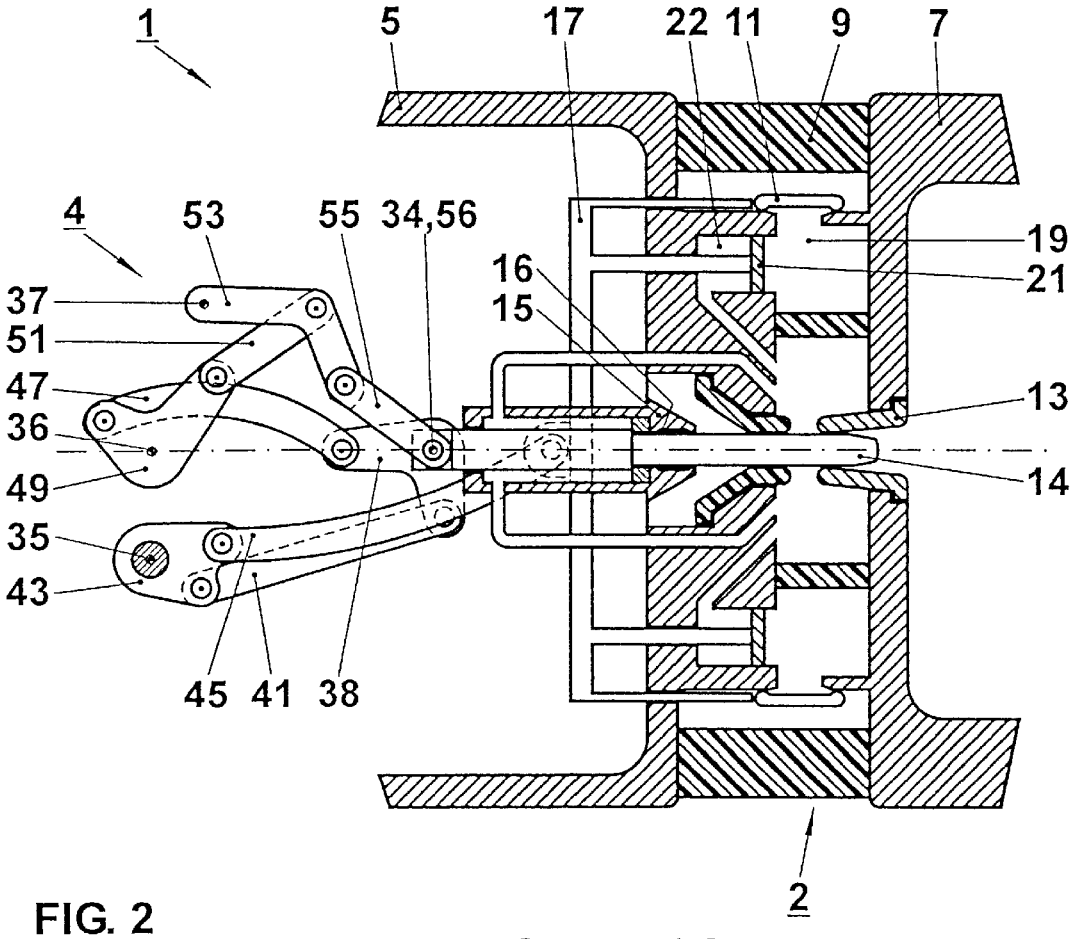
FIG. 2 shows this embodiment of the power breaker, illustrated in a highly simplified form, in the connected state.

FIG. 2 shows the first embodiment of the power breaker 1, illustrated in a highly simplified form, in the connected state. This corresponds to the time $T_1$ in FIG. 6. The angled lever 38 has been rotated counterclockwise by the drive in order to move the power breaker 1 from the disconnected position illustrated in FIG. 1 to the connected position illustrated in FIG. 2. The power breaker 1 is disconnected when the angled lever 38 rotates clockwise. The drive linkage 4 can very easily and continuously be matched to the requirements for travel and speed of the respective power breaker type to be driven by varying the length of the limbs and the angle between the limbs of the angled lever 38. The other components of the drive linkage 4 can also be modified appropriately for further matching operations.

Figure 3:
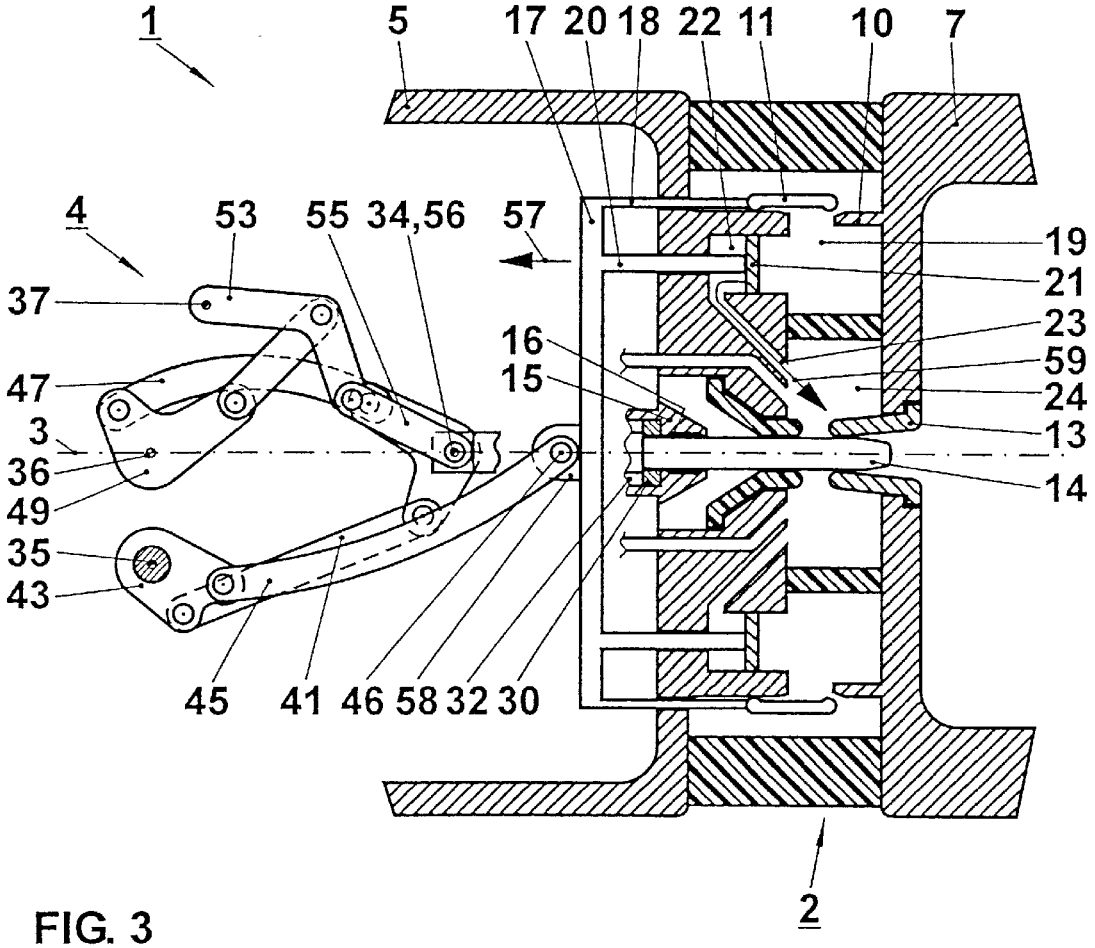
FIGS. 3, 4 and 5 show various significant positions in the first embodiment of the power breaker in the course of its disconnection movement.
Figure 4:
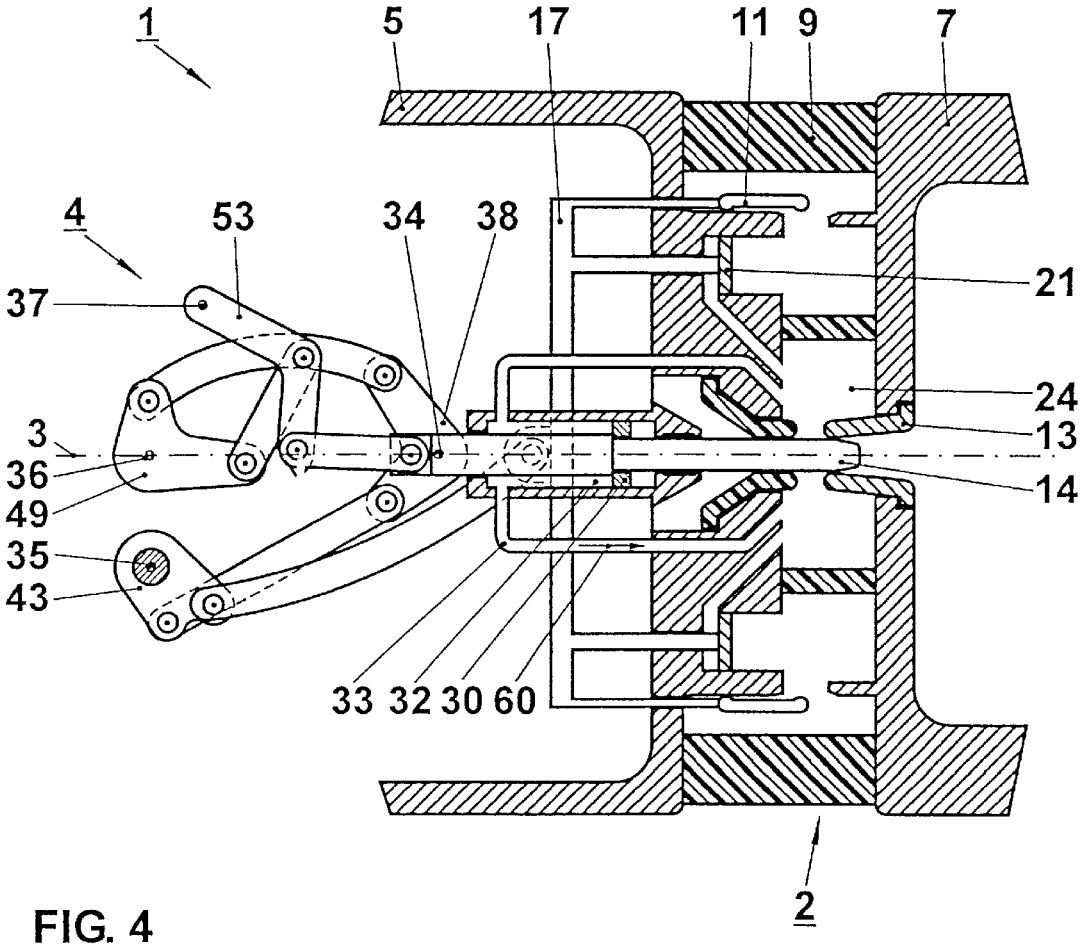
Figure 5:
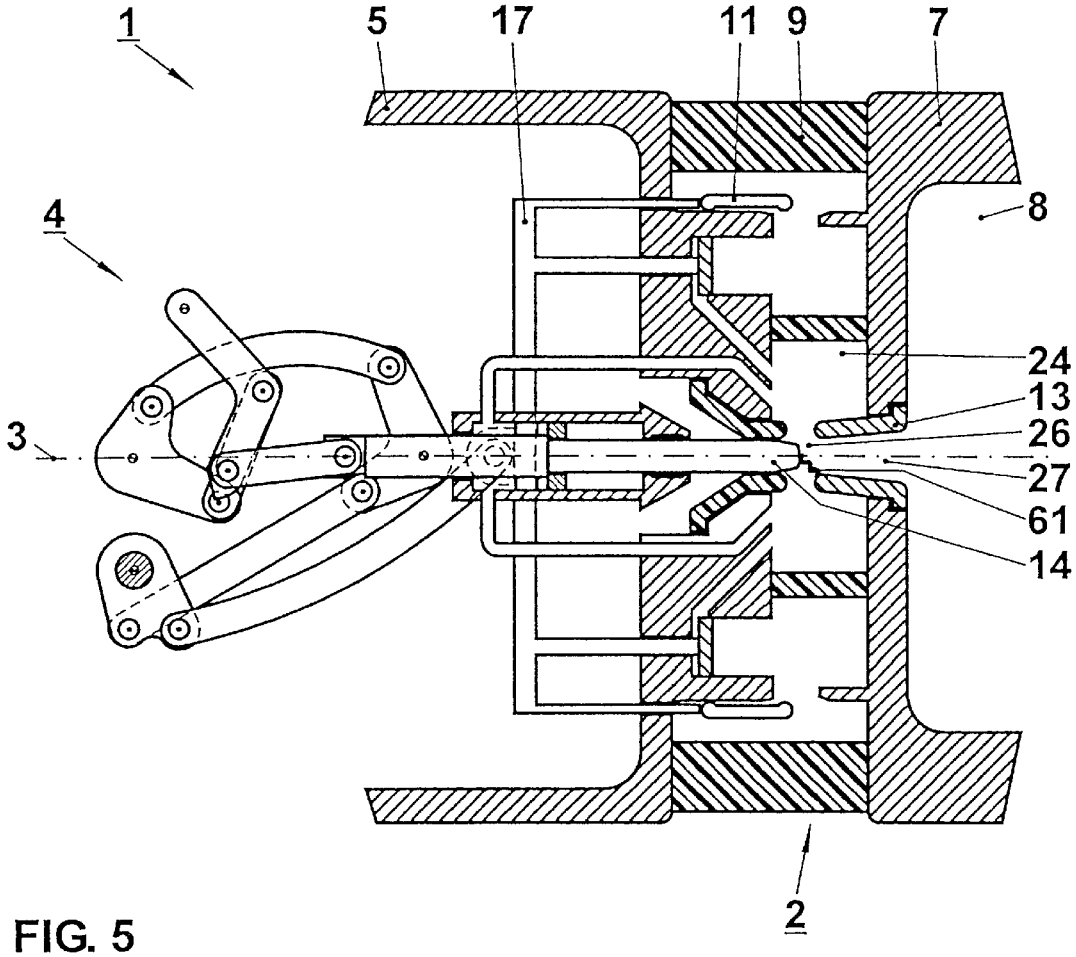

FIGS. 3, 4 and 5 show various significant positions of the power breaker 1 in the course of its disconnection movement. FIG. 3 shows the power breaker 1 in the position immediately after interruption of the rated current path, in which the rated current contacts 11 have just been disconnected from the contact facing 10, and this corresponds to the time $T_2$ in FIG. 6. The angled lever 38 has been rotated somewhat counterclockwise, and the ring 17, and with it the rated current contacts 11 and the pistons 21, move in the direction of the arrow 57 parallel to the longitudinal axis 3. The power is transmitted from the angled lever 38 via the lever 41, the angled lever 43 and the lever 45 to a lug 58 which is rigidly connected to the ring 17 and in which the rotation point 46 is mounted. As already stated, a further such lug and an identical lever connection connected to it are provided symmetrically with respect to this lug 58. Although the rated current contacts 11 are already moving in the disconnection direction, the contact pin 14 of the power current path still remains in the connected position. At the same time as the rated current contacts 11, the piston 21 moves and starts to compress the insulating medium in the compression volume 22. As indicated by an arrow 59, the pressurized medium flows through the flow channel 23 out of the compression volume 22 into the storage volume 24, where it is initially stored. The second linkage element, which operates the contact pin 14, initially still remains in a dead point position, however.

The rated current contacts 11 and the piston or pistons 21 move comparatively slowly further in the disconnection direction but, as soon as the dead point of the second linkage element is passed, the contact pin 14, as can be seen from FIG. 4, starts its disconnection travel at a comparatively high maximum speed. This corresponds to the time $T_3$ in FIG. 6. The piston 30 compresses the insulating medium in the compression volume 32. As indicated by an arrow 60, the pressurized medium flows through the flow channels 33 out of the compression volume 32 into the storage volume 24, where it is initially stored.

On reaching its travel $H_1$, the rated current contacts 11 still have considerable kinetic energy owing to their comparatively large mass. This kinetic energy is emitted via the drive linkage 4 to the contact pin 14 which, at this time $T_3$, is still well away from reaching its maximum disconnection speed, in order to accelerate it further. The drive of the power breaker 1 can thus be designed to be somewhat weaker and hence cheaper since, during the acceleration of the contact pin 14, it is advantageously assisted by this kinetic energy, which otherwise cannot be used.

FIG. 5 shows the power breaker 1 immediately after contact disconnection in the power current path, with an arc 61 burning between the erosion-resistant contact finger arrangement 13 and the contact pin 14 and heating the arcing zone 26 and, with it, the storage volume 24. A portion of the hot gas has, however, already flown out of the arcing zone 26 through the opening 27 into the blow-out volume 8. This corresponds to the time $T_4$ in FIG. 6. The rated current contacts 11 and the pistons 21 have already reached their definitive disconnected position, so that no pressurized insulating medium continues to flow into the storage volume 24 from the compression volumes 22. The piston 30, which is connected to the contact pin 14, compresses the insulating medium in the compression volume 32 and it continues to flow through the flow channels 33 into the storage volume 24, in order to assist the process of blowing out the arc 61, provided the pressure conditions there allow this.

The contact pin 14 now moves further in the disconnection direction and then releases the opening 28, which allows an additional flow of hot gases out of the arcing zone 26 into the blow-out volume 6. The cooling of the arc 61 in this region is particularly intensive, so that it is generally quenched before the contact pin 14 has reached its definitive disconnected position. Immediately before reaching this disconnected position, the piston 30 closes the inlets of the flow channels 33, so that the remaining residue of the compression volume 32 can from now on be used as a pneumatic damping volume, in order effectively to damp out the remaining kinetic energy of the contact pin 14 on reaching the disconnected position. The disconnected position illustrated in FIG. 1 is reached definitively at the time $T_5$.

The connection movement of the power breaker 1 takes place in the opposite sense to the disconnection movement described above. At the start of the connection process, the rated current contacts 11 remain in a dead point position until the pre-arcing of the switch-on arc between the already moving contact pin 14 and the erosion-resistant contact finger arrangement 13 takes place. They do not move away from one another in the connection direction until after this, and do not close the rated current circuit until the switch-on arc is no longer burning, that is to say once the contact pin 14 has moved into the contact finger arrangement 13.

Figure 7A:
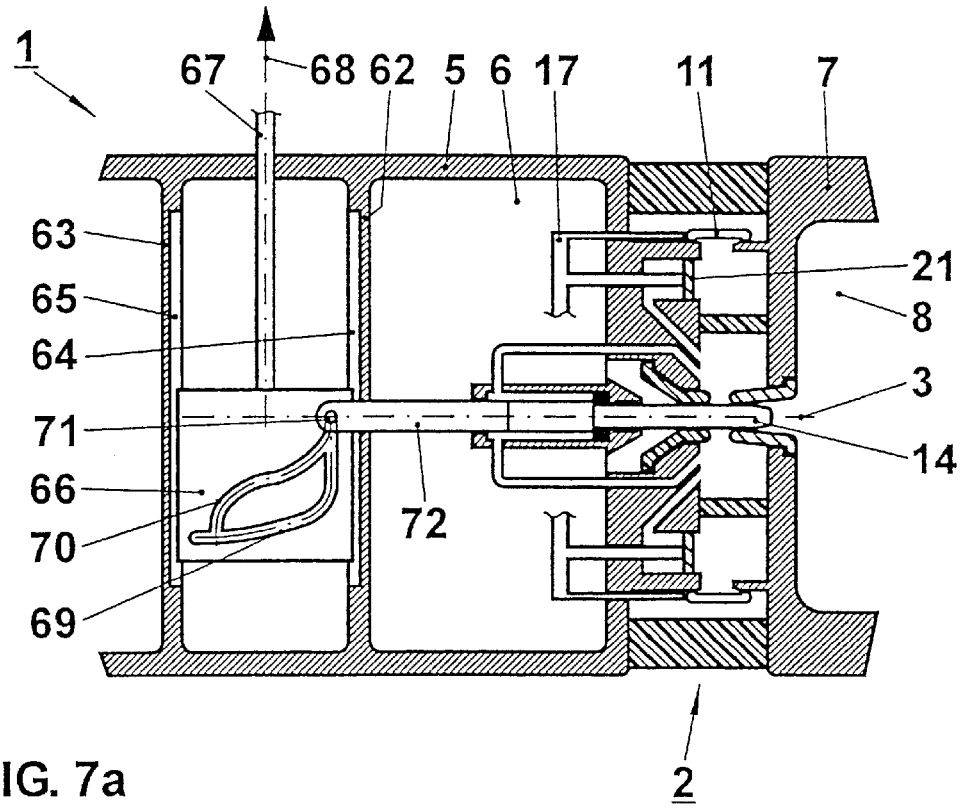
Figure 7B:
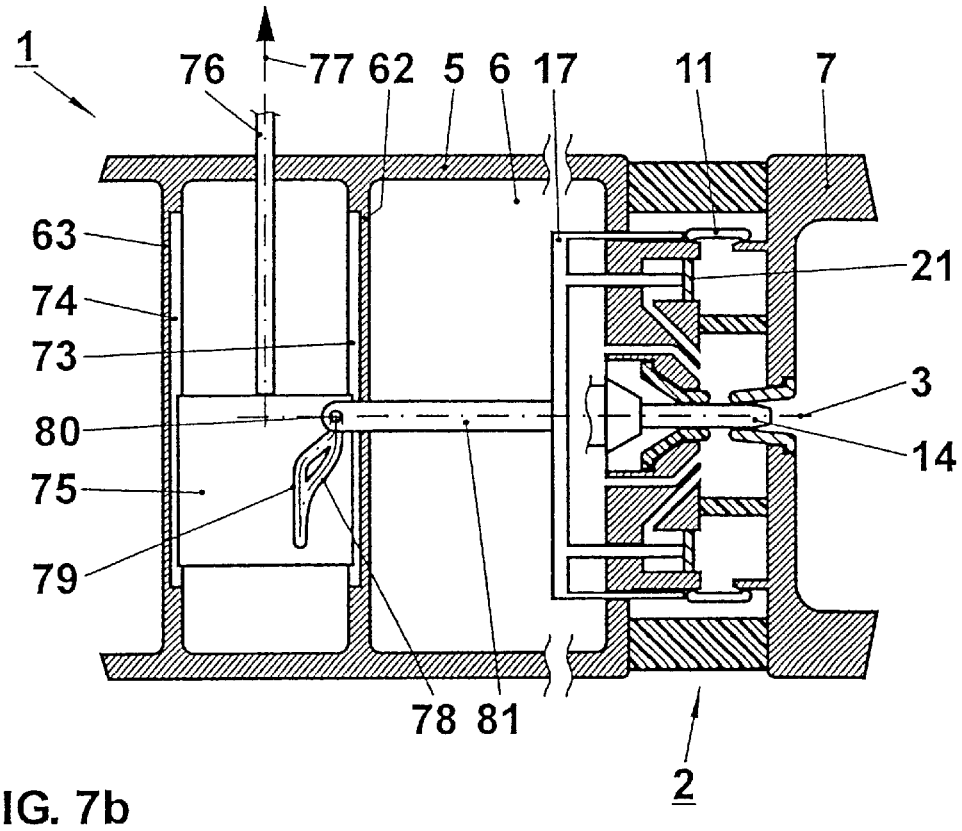
Figure 7C:
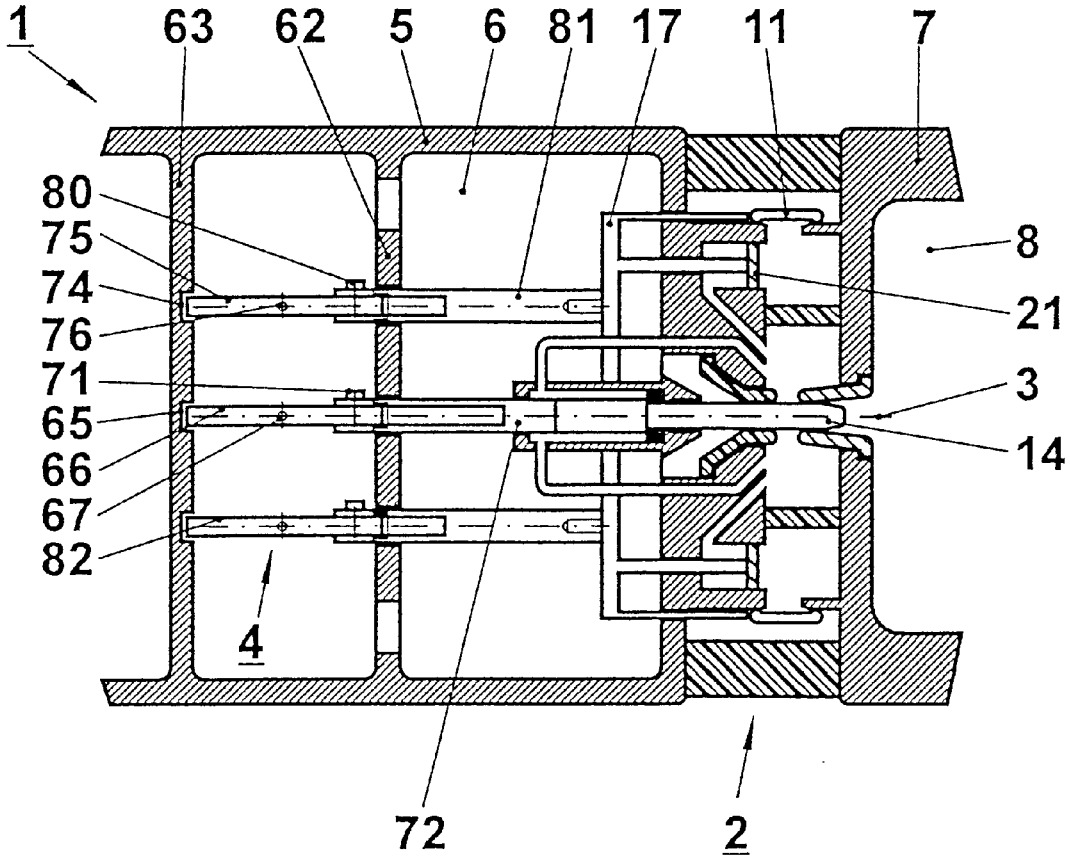

FIGS. 7*a*, 7*b* and 7*c* illustrate a second embodiment of the power breaker 1 in the connected state. This position corresponds to the time $T_1$ in FIG. 6. The arcing chamber 2 and the blow-out housing 7 are constructed in the same way as in the first embodiment. A partially cut-through intermediate wall 62 has additionally been inserted into the housing 5, and extends at right angles to the longitudinal axis 3. The blow-out volume 6 thus extends as far as the side of the intermediate wall 62 facing away from the arcing chamber 2. The blow-out volume 6 is closed off by a wall 63 which is integrally formed in a pressure tight manner on the housing 5 and extends at right angles to the longitudinal axis 3.

As shown in FIG. 7*a*, guide grooves 64 and 65 which are precisely opposite and parallel to one another are incorporated in the intermediate wall 62 and in the wall 63, and are used as guides for a guide plate 66. The guide grooves 64 and 65 run radially with respect to the longitudinal axis 3. This guide plate 66 is connected by means of an electrically insulating tie rod 67 to the drive (not illustrated), and can move upward in the direction of the arrow 68. The tie rod 67 is passed through the wall of the housing 5 in a pressure tight manner. Guide grooves 69 and 70 are milled into the guide plate 66, and the end of a bolt 71 is guided in them. The bolt 71 is mounted at one end in a retaining fork 72 which is rigidly connected to the contact pin 14. As can be seen from FIG. 7*c*, the retaining fork 72 surrounds the guide plate 66, so that the bolt 71 can engage in the guide grooves 69 and 70 from above. The retaining fork 72 is designed such that the bolt 71 cannot become disengaged from the guide grooves 69 and 70. The retaining fork 72 is guided in the axial direction in the intermediate wall 62.

As can be seen from FIGS. 7*b* and 7*c*, further guide grooves 73 and 74 are incorporated in the intermediate wall 62 and in the wall 63 parallel to the guide grooves 64 and 65 and at a distance from them, and are used as guides for a guide plate 75. This guide plate 75 is connected by means of an electrically insulating tie rod 76 to the drive (not illustrated) and can move in the direction of the arrow 77. The tie rod 76 is passed in a pressure tight manner through the wall of the housing 5. Guide grooves 78 and 79 are milled in the guide plate 75, and the end of a bolt 80 is guided in them. The bolt 80 is mounted at one end in a retaining fork 81 which is rigidly connected to the ring 17. As can be seen from FIG. 7*c*, the retaining fork 81 surrounds the guide plate 75, so that the bolt 80 can engage in the guide grooves 78 and 79 from above. The retaining fork 81 is designed such that the bolt 80 cannot become disengaged from the guide grooves 78 and 79. The retaining fork 81 is guided in the axial direction in the intermediate wall 62.

In order to prevent the ring 17 from tilting during operation of the rated current contacts 11 and of the pistons 21, a further identical guide plate 82 is provided on the other side of the guide plate 66 and at the same distance from it as the guide plate 75, and this is designed identically and is guided and operated in the same way as the guide plate 75, and its retention need therefore not be described in any more detail here.

Figure 8A:
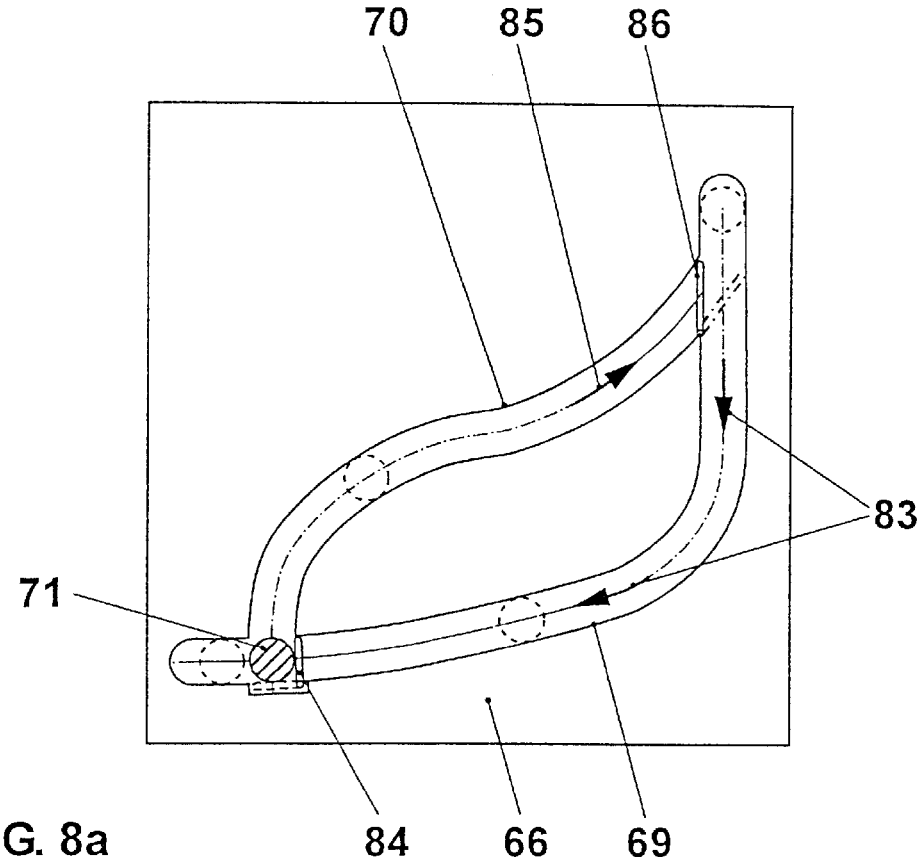
FIGS. 8*a* and 8*b* show highly simplified design details of the second embodiment of the power breaker, FIGS. 9*a*, 9*b*, 10*a* and 10*b* have two significant positions of the second embodiment of the power breaker in the course of its disconnection movement.

The guide plate 66 for operation of the contact pin 14 is illustrated schematically in FIG. 8*a*. The arrows 83 in the guide groove 69 indicate the direction in which the bolt 71 is moved when the guide plate 66 is drawn upward during disconnection of the power breaker 1. The bolt 71 is used to move the retaining fork 72 and, with it, the contact pin 14, axially in the disconnection direction. The speed of the drive and the curve shape of the guide groove 69 are chosen so that the contact pin 14 carries out the movement illustrated by curve C in FIG. 6.

Shortly before the contact pin 14 reaches its disconnected position, a flap 84, on which a spring (not illustrated) acts, is pressed against the force of this spring into a depression in the wall of the guide groove 69, so that the bolt 71 can pass. As soon as the bolt 71 has passed the flap 84, the flap 84 blocks the guide groove 69, and the bolt 71 is moved back into the position illustrated in FIG. 8*a* by means of the force of a spring (not illustrated). During connection, when the guide plate 66 is pressed downward, the bolt 71 is moved in the direction of the arrow 85 in the guide groove 70. The profile of the connection movement of this second embodiment of the power breaker 1 therefore differs somewhat from that of the first embodiment of the power breaker 1. Shortly before the contact pin 14 reaches its connected position, a flap 86, on which a spring (not illustrated) acts, is pressed out of the way against the force of this spring so that the bolt 71 can pass. As soon as the bolt 71 has passed the flap 86, the flap 86 blocks the guide groove 70, and the contact pin 14 and, with it, the bolt 71 are now located in their definitive connected position.

Figure 8B:
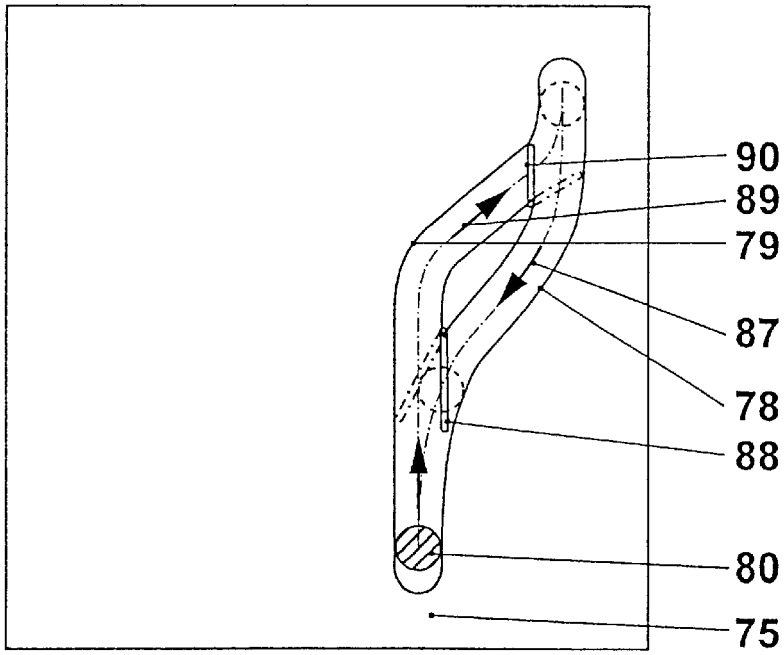

The guide plate 75 for operation of the rated current contacts 11 and of the pistons 21 is illustrated schematically in FIG. 8*b*. The arrow 87 in the guide groove 78 indicates the direction in which the bolt 80 is moved when the guide plate 75 is drawn upward during disconnection of the power breaker 1. The bolt 80 is used to move the retaining fork 81 and, with it, the ring 17 axially in the disconnection direction. The speed of the drive and the curve shape of the guide groove 78 are chosen such that the ring 17 and, with it, the rated current contacts 11 carry out the movement illustrated by curve B in FIG. 6. Shortly before the rated current contacts 11 reach their disconnected position, a flap 88, on which a spring (not illustrated) acts, is pressed to the side against the force of this spring, so that the bolt 80 can pass. As soon as the bolt 80 has passed the flap 88, the flap 88 blocks the guide groove 78. During connection, when the guide plate 75 is pressed downward, the bolt 80 is moved in the direction of the arrow 89 in the guide groove 79. The profile of the connection movement in this second embodiment of the power breaker 1 therefore differs somewhat from that of the first embodiment of the power breaker 1. Shortly before the rated current contacts 11 reach their connected position, a flap 90, on which a spring (not illustrated) acts, is pressed out of the way against the force of this spring, so that the bolt 80 can pass. As soon as the bolt 80 has passed the flap 90, the flap 90 blocks the guide groove 79, and the rated current contacts 11 and, with them, the bolt 80 are located in their connected position. As already stated, the guide plate 82 is designed to be exactly identical to the guide plate 75 described here.

In order to reduce the number of pressure-tight bushings for the tie rods 67 and 76, these operating elements can be combined for joint operation in the interior of the housing 5, so that only a single bushing is required through the wall of the housing 5. However, in principle, it is also possible to move the contact pin 14 and the rated current contacts 11 by means of two separate drives, in order in this way to achieve a greater range of adjustable movement profiles.

Figure 9A:
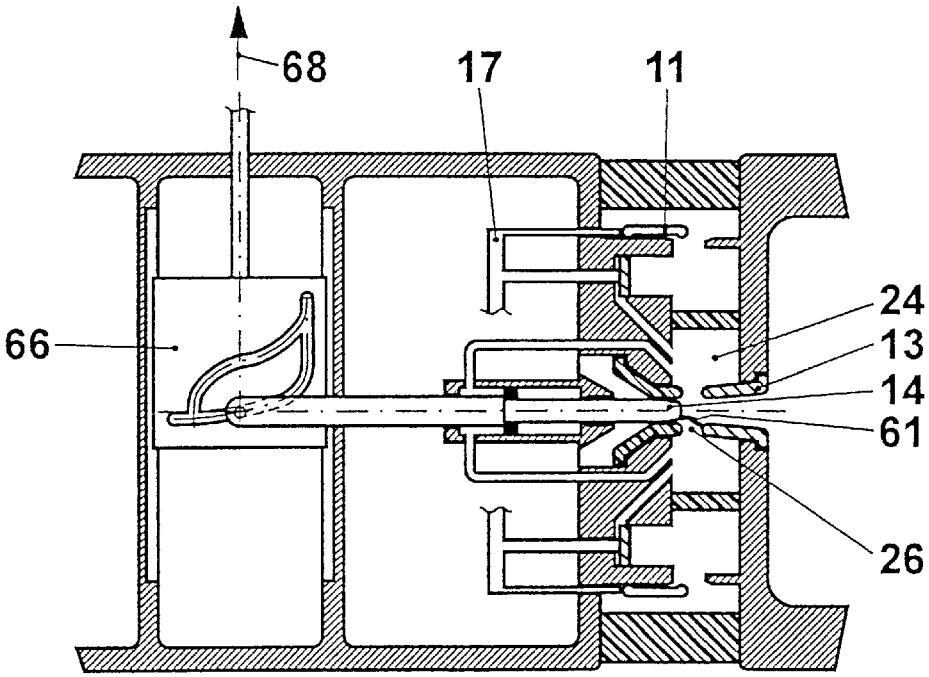
Figure 9B:
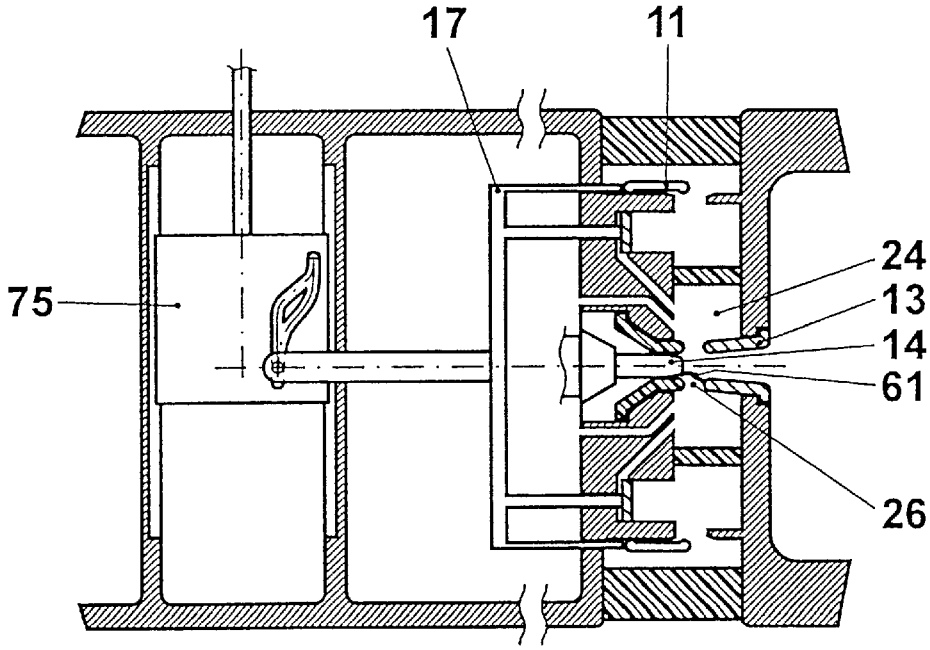
Figure 10A:
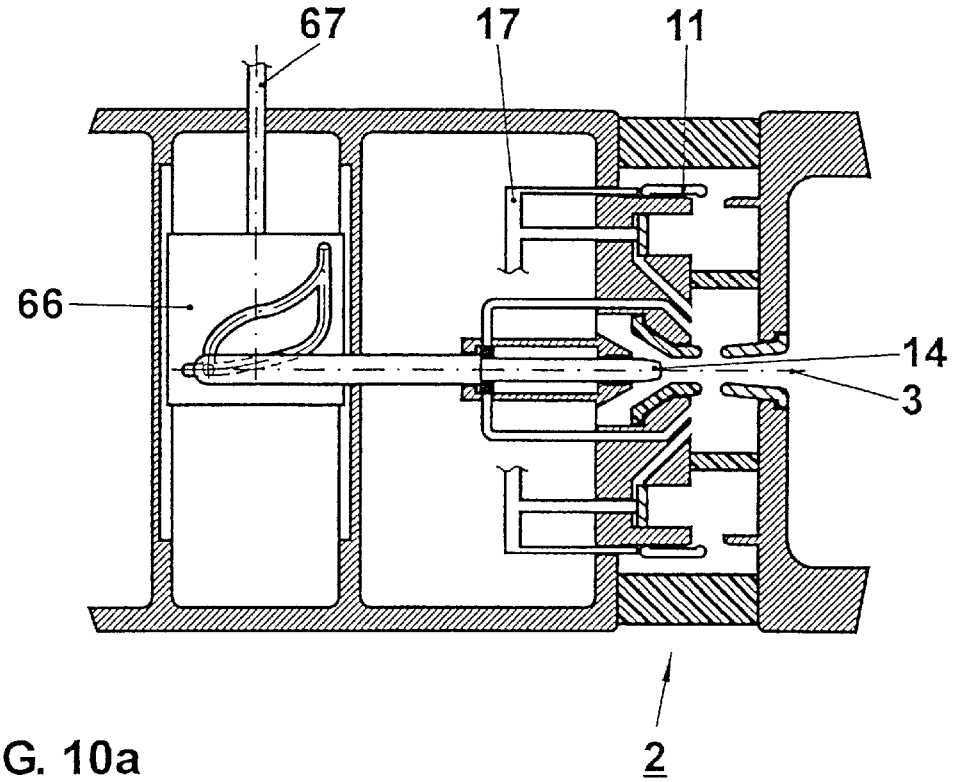
Figure 10B:
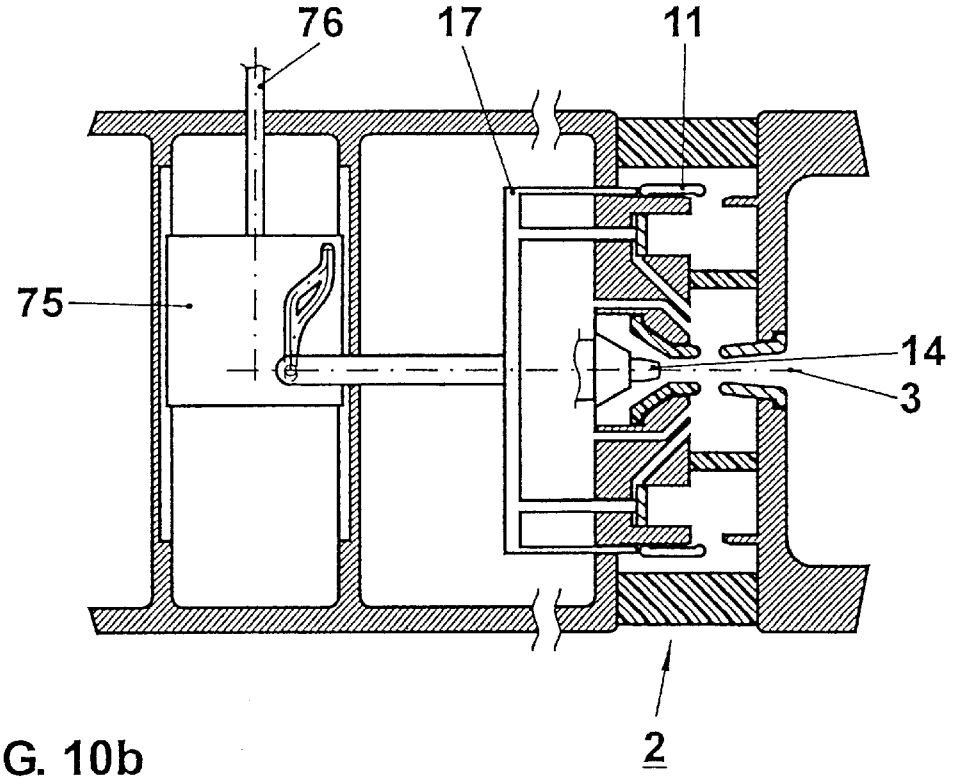

FIGS. 9*a* and 9*b* show the power breaker 1 in the position which corresponds approximately to the time $T_4$ in FIG. 6. FIG. 9*a* shows the operation of the contact pin 14, and FIG. 9*b* shows the rated current contacts 11 in a dead point position. An arc 61 burns between the erosion-resistant contact finger arrangement 13 and the contact pin 14, and heats the arcing zone 26 and, with it, the storage volume 24. However, a portion of the hot gas has already flowed out of the arcing zone 26, etc., as has already been described above. FIGS. 10*a* and 10*b* show the second embodiment, illustrated in a highly simplified form, of the power breaker 1 in the definitively disconnected state.

The power breaker 1 is designed for particularly large currents, in particular also large rated currents and short-circuit currents, such as those that can occur, for example, in the area downstream of the generator in a power station. Particularly if large short-circuit currents flow in the event of a fault, stay currents can occur in all the metal parts over the vicinity of the current path. It has thus been found to be worthwhile, in order to avoid consequential damage caused by stray currents, to design the metal parts of the drive linkage 4 such that there can be no metallic contact between them.

The described movement sequences can also be achieved very easily by means of a hydraulic drive. Such a drive is particularly advantageous wherever hydraulic control systems are already used for other purposes, as is the situation in many power stations, so that there is no need to produce a separate hydraulic system, thus allowing a further cost-effective drive version to be used.

What is claimed as new and desired to be secured by Letters Patent of the United States is:

1. A power breaker having at least one arcing chamber, which is filled with an insulating medium, in particular $SF_6$ gas, is rotationally symmetrical, extends along a longitudinal axis, has a power current path with a centrally located contact pin and has a separate rated current path which is provided with rated current contacts, and having a drive linkage which operates the contact pin and the rated current contacts, characterized in that the drive linkage is designed such that, at the start of the disconnection process, the contact pin remains in a first dead point position until the rated current path is interrupted, in that the contact pin can then be moved in the disconnection direction at a higher average speed than the rated current contacts, in that the rated current contacts run into a second dead point position toward the end of their disconnection travel, and in that the contact pin does not reach its disconnected position until after the rated current contacts have ended their disconnection movement.

2. The power breaker as claimed in claim 1, characterized in that, at the start of a connection process, the rated current contacts remain in the second dead point position until the pre-arcing of the switch-on arc takes place.

3. The power breaker as claimed in claim 1, characterized in that at least one first piston-cylinder arrangement is provided which moves such that it is coupled to the rated current contacts and which a portion of the insulating medium is pressurized in a compression volume by a piston during disconnection.

4. The power breaker as claimed in claim 1, characterized in that at least a portion of the kinetic energy which the rated current contacts have toward the end of their disconnection travel can be used with the aid of the drive linkage for acceleration of the contact pin.

5. The power breaker as claimed in claim 1, characterized in that the overall travel and the average speed of the contact pin are always greater than the overall travel and the average speed of the rated current contacts.

6. The power breaker as claimed in claim 5, characterized in that the contact pin is driven at maximum connection and disconnection speeds in the range from 10 to 20 m/s, and in that the rate current contacts are driven at maximum connection and disconnection speeds in the range from 2 to 6 m/s.

7. The power breaker as claimed in claim 3, characterized in that at least one second piston-cylinder arrangement is provided, in which a portion of the insulating medium in a compression volume is compressed by means of a piston, which is coupled to the contact pin, during disconnection, so that it can be used for blowing out the arc, and in which, furthermore, the compression volume is used as a pneumatic damping volume toward the end of the disconnection travel of the contact pin.

8. The power breaker as claimed in claim 1, characterized in that the drive linkage has two linkage elements, the first of which is provided for operating the rated current contacts and pistons, and the second of which is provided for operating the contact pin.

9. The power breaker as claimed in claim 8, characterized in that the two linkage elements are articulated on a respective limb of an angled lever, which can rotate at the tip about a fixed-position rotation axis and in that the two linkage elements each pass through the same path, in the opposite direction in each case, both during disconnection and during connection.

10. The power breaker as claimed in claim 8, characterized in that, in the first linkage element, a lever connects the angled lever to a first limb of a second angled lever whose tip can rotate about a second fixed-position rotation axis, and in that a second limb of the second angled lever is connected by means of a lever to a rotation point on a ring, and in that, in the second linkage element, a lever connects the angled lever to a first limb of a third angled lever whose tip can rotate about a third fixed-position rotation axis, and in that a second limb of the third angled lever is connected by means of a lever to a moving rotation point at the tip of the fourth angled lever, wherein a first limb of the fourth angled lever can rotate about a fourth fixed-position rotation axis, while a second limb is connected in a hinged manner by means of a lever to a rotation point which moves axially and is fitted on the contact pin.

11. The power breaker as claimed in claim 8, characterized in that the first linkage element is provided with a first moving guide plate, and in that the second linkage element is provided with at least one second moving guide plate, and in that the first guide plate and the at least one second guide plate are designed such that they can be driven jointly or separately.

12. The power breaker as claimed in claim 11, characterized in that at least one of the two linkage elements in each case passes through an at least partially different path during connection and during disconnection.

13. The power breaker as claimed in claim 11, characterized in that there are two second guide plates, wherein these two guide plates are each arranged at the same distance on either side of the first guide plate.

14. The power breaker as claimed in claim 11, characterized in that guide grooves are incorporated in the guide plates, in that a bolt in each guide plate, engages with the guide grooves, in that the bolts are held in retaining forks, and in that these retaining forks are guided such that they move parallel to the longitudinal axis.

15. The power breaker as claimed in claim 14, characterized in that the guide grooves are provided with flaps which ensure that the bolt is guided along different paths during connection and disconnection.

* * * * *